US011424062B2

(12) United States Patent
Yamaguchi

(10) Patent No.: US 11,424,062 B2
(45) Date of Patent: Aug. 23, 2022

(54) FLEXIBLE INDUCTOR

(71) Applicant: Murata Manufacturing Co., Ltd., Kyoto-fu (JP)

(72) Inventor: Koichi Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 356 days.

(21) Appl. No.: 15/863,546

(22) Filed: Jan. 5, 2018

(65) Prior Publication Data

US 2018/0130596 A1 May 10, 2018

Related U.S. Application Data

(63) Continuation of application No. PCT/JP2016/068777, filed on Jun. 24, 2016.

(30) Foreign Application Priority Data

Jul. 24, 2015 (JP) ..... JP2015-146890

(51) Int. Cl.
*H01F 27/245* (2006.01)
*H01F 27/28* (2006.01)
(Continued)

(52) U.S. Cl.
CPC ..... *H01F 27/2804* (2013.01); *H01F 17/0013* (2013.01); *H01F 27/245* (2013.01);
(Continued)

(58) Field of Classification Search
CPC .... H01F 27/2804; H01F 27/245; H01F 27/29; H01F 27/292; H01F 41/0233; H01F 41/10; H01F 2017/006; H01F 17/0013
See application file for complete search history.

(56) References Cited

U.S. PATENT DOCUMENTS

2002/0009577 A1* 1/2002 Takaya ..... H03H 7/0115 428/209
2005/0253677 A1* 11/2005 Ito ..... H01F 17/0013 336/200
(Continued)

FOREIGN PATENT DOCUMENTS

CN 1838349 A 9/2006
JP S55-024490 A 2/1980
(Continued)

OTHER PUBLICATIONS

International Search Report issued in PCT/JP2016/068777; dated Sep. 13, 2016.
(Continued)

*Primary Examiner* — Uyen M Tran
(74) *Attorney, Agent, or Firm* — Studebaker & Brackett PC

(57) ABSTRACT

A flexible inductor mounted on a flexible substrate can be deformed while following deflection of the flexible substrate over time, and has high resistance to drop impact. The flexible inductor includes a coil substrate having a spiral conductor on at least one of upper and lower surfaces, and first and second magnetic sheets laminated on the upper and lower surfaces, respectively. First and second outer electrodes are provided in a peripheral edge portion of the lower surface. The first and second electrodes make direct contact with the lower surface, and are electrically connected to outermost and innermost end portions, respectively, of the spiral conductor. The second magnetic sheet is laminated on the lower surface other than portions corresponding to the first and second outer electrodes. Thicknesses of the first and second outer electrodes are equal to or larger than a thickness of the second magnetic sheet.

8 Claims, 11 Drawing Sheets

(51) Int. Cl.

| | |
|---|---|
| ***H01F 17/00*** | (2006.01) |
| ***H01F 27/29*** | (2006.01) |
| ***H01F 41/02*** | (2006.01) |
| ***H01F 41/10*** | (2006.01) |

(52) U.S. Cl.
CPC ..... *H01F 27/29* (2013.01); *H01F 27/292* (2013.01); *H01F 41/0233* (2013.01); *H01F 41/10* (2013.01); *H01F 2017/006* (2013.01)

(56) References Cited

U.S. PATENT DOCUMENTS

| | | | | |
|---|---|---|---|---|
| 2008/0218301 | A1* | 9/2008 | Yamaguchi | H01F 17/0013 336/83 |
| 2010/0001823 | A1* | 1/2010 | Kawarai | H01F 17/0013 336/200 |
| 2010/0259352 | A1 | 10/2010 | Yan et al. | |
| 2012/0112869 | A1* | 5/2012 | Nishikawa | H01F 17/0013 336/200 |
| 2014/0009254 | A1* | 1/2014 | Oh | H01F 27/29 336/192 |

FOREIGN PATENT DOCUMENTS

| | | | | |
|---|---|---|---|---|
| JP | S5524490 | * | 2/1980 | H01F 17/00 |
| JP | H07-057945 | A | 3/1995 | |
| JP | 2002-217033 | A | 8/2002 | |
| JP | 2009-009985 | A | 1/2009 | |
| JP | 2013-526036 | A | 6/2013 | |

OTHER PUBLICATIONS

Written Opinion issued in PCT/JP2016/068777; dated Sep. 13, 2016.

An Office Action mailed by the Chinese Patent Office dated Nov. 14, 2018, which corresponds to Chinese Patent Application No. 20160043219.7 and is related to U.S. Appl. No. 15/863,546 with English language translation.

* cited by examiner

FLEXIBLE INDUCTOR

CROSS-REFERENCE TO RELATED APPLICATIONS

This application claims benefit of priority to International Patent Application No. PCT/JP2016/068777, filed Jun. 24, 2016, and to Japanese Patent Application No. 2015-146890, filed Jul. 24, 2015, the entire contents of each are incorporated herein by reference.

BACKGROUND

Technical Field

The present disclosure relates to a flexible inductor that is mounted on a flexible substrate.

Background Art

In recent years, an inductor that is mounted on a flexible substrate is also required to be reduced in size and thickness with reduction of an electronic apparatus such as a cellular phone in size and thickness. A conventional inductor however has the problem that it is weak to bending and drop impact because the conventional inductor uses a ferrite sintered body having high rigidity for a core.

For solving this problem, as an inductor that can be deformed while following deflection of a flexible substrate when it is mounted on the substrate, and has high resistance to drop impact, for example, Japanese Unexamined Patent Application Publication No. 2009-9985 discloses a flexible inductor in which a composite magnetic sheet formed by dispersing soft magnetic metal powder in a resin material is laminated on a film-like coil.

SUMMARY

The flexible inductor disclosed in Japanese Unexamined Patent Application Publication No. 2009-9985 has the configuration in which an outermost end of an air core coil provided by forming a conductor pattern in a spiral form in a plane is connected to an outer electrode formed by a so-called five-surface electrode with an extended conductor interposed therebetween, the five-surface electrode covering an end surface of the flexible inductor in the width direction and parts of four surfaces adjacent to the end surface. The flexible inductor is mounted on a flexible substrate by connecting the outer electrode to a mounting terminal of the flexible substrate by solder.

The flexible inductor disclosed in Japanese Unexamined Patent Application Publication No. 2009-9985 however has the problem that stress when the flexible substrate on which the flexible inductor has been mounted is deflected concentrates on a connection portion of the extended conductor and the outer electrode and the connection portion is easy to be disconnected. In particular, when the five-surface electrode is employed, a solder fillet is formed so as to make contact with a side surface of the outer electrode. Therefore, the stress when the flexible substrate is deflected directly acts on the side surface of the outer electrode and is therefore large. The stress acts in the direction of expanding and contracting the flexible substrate on which the air core coil has been formed. In particular, metal forming the extended conductor has almost no stretchability and the extended conductor is therefore peeled off in the connection portion of the extended conductor and the outer electrode.

As a method for decreasing the stress when the flexible substrate on which the flexible inductor has been mounted is deflected, a method in which the outer electrode is provided on only the bottom surface of the flexible inductor, that is, a mounting surface so as not to form the solder fillet can be used. The method is not, however, preferable for the conventional flexible inductor because the following new problem occurs. That is, the outer electrode is formed on the composite magnetic sheet, and when the flexible inductor is mounted on the flexible substrate, the outer electrode is easy to be peeled off from the composite magnetic sheet because close contact strength of the outer electrode with the composite magnetic sheet is weak.

The present disclosure provides a flexible inductor that can be deformed while following deflection of a flexible substrate over time when the flexible inductor is mounted on the flexible substrate, and has high resistance to mechanical impact such as drop. A flexible inductor according to a first aspect of the present disclosure includes a coil substrate having a spiral conductor on at least one of an upper surface and a lower surface; and a first magnetic sheet laminated on the upper surface of the coil substrate and a second magnetic sheet laminated on the lower surface of the coil substrate. A first outer electrode that makes direct contact with the lower surface of the coil substrate and is electrically connected to an outermost end portion of the spiral conductor, and a second outer electrode that makes direct contact with the lower surface of the coil substrate and is electrically connected to an innermost end portion of the spiral conductor, are provided in a peripheral edge portion of the lower surface of the coil substrate and the second magnetic sheet is laminated on the lower surface of the coil substrate other than portions corresponding to the first outer electrode and the second outer electrode. The thicknesses of the first outer electrode and the second outer electrode are equal to a thickness of the second magnetic sheet or are larger than the thickness of the second magnetic sheet.

With the first aspect, the outer electrodes are directly provided on the coil substrate. Therefore, the coil substrate can be deformed while following deflection of a flexible substrate. Accordingly, strength against deformation is increased and resistance to mechanical impact can be increased.

According to a second aspect of the present disclosure, the first outer electrode and the second outer electrode are assemblies of a plurality of conductors, in the first aspect. With the second aspect, the outer electrodes are easy to be deformed overall when receiving stress. Therefore, stress that is applied to a connection portion of the outermost end portion of the spiral conductor and the outer electrode is dispersed and moderated, thereby further increasing the strength against deflection.

According to a third aspect of the present disclosure, the first outer electrode and the second outer electrode are columnar or plate-like conductors, in the first aspect. With the third aspect, the first outer electrode and the second outer electrode are easy to be deformed in lateral directions. Therefore, the stress that is applied to the connection portion of the outermost end portion of the spiral conductor and the outer electrode is dispersed and moderated, thereby further increasing the strength against deflection.

According to a fourth aspect of the present disclosure, the coil substrate has one or a plurality of cutout portions in the vicinity of at least one of the first outer electrode and the second outer electrode, in the first aspect. With the fourth aspect, the coil substrate is easy to be deformed in the vicinity of the cutout portion when receiving the stress.

Therefore, the stress that is applied to the connection portion of the outermost end portion of the spiral conductor and the first outer electrode and/or the second outer electrode can be further dispersed and moderated.

According to a fifth aspect of the present disclosure, the coil substrate has a square lower surface, the first outer electrode, the second outer electrode, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate. The second magnetic sheet is laminated on the lower surface of the coil substrate other than portions corresponding to the first outer electrode, the second outer electrode, the third outer electrode, and the fourth outer electrode. The thicknesses of the first outer electrode, the second outer electrode, the third outer electrode, and the fourth outer electrode are equal to the thickness of the second magnetic sheet or are larger than the thickness of the second magnetic sheet, in the first aspect. With the fifth aspect, even when the flexible substrate on which the inductor is mounted is bent in any of the X direction and the Y direction, the stretchability can be kept in both of the directions.

According to a sixth aspect of the present disclosure, the coil substrate has one or a plurality of cutout portions in the vicinity of at least one of the third outer electrode and the fourth outer electrode, in the fifth aspect. With the sixth aspect, the coil substrate is easy to be deformed in the vicinity of the cutout portion when receiving stress. Therefore, the stress that is applied to interfaces between the coil substrate and the third outer electrode and/or the fourth outer electrode can be further dispersed and moderated.

Furthermore, the flexible inductor according to the first aspect of the present disclosure can be manufactured using, for example, the following manufacturing method. That is, a method for manufacturing a flexible inductor which includes a coil substrate having a spiral conductor on at least one of an upper surface and a lower surface, and a first magnetic sheet laminated on the upper surface of the coil substrate and a second magnetic sheet laminated on the lower surface of the coil substrate. The method includes forming a first outer electrode that makes direct contact with the lower surface of the coil substrate and is electrically connected to an outermost end portion of the spiral conductor, and a second outer electrode that makes direct contact with the lower surface of the coil substrate and is electrically connected to an innermost end portion of the spiral conductor in a peripheral edge portion of the lower surface of the coil substrate. The method further includes laminating the second magnetic sheet on the lower surface of the coil substrate other than portions corresponding to the first outer electrode and the second outer electrode so as to have a thickness that is equal to thicknesses of the first outer electrode and the second outer electrode or is smaller than the thicknesses of the first outer electrode and the second outer electrode. With this manufacturing method, the flexible inductor that can be deformed while following deflection of the flexible substrate over time and has the high resistance to mechanical impact can be easily manufactured.

A flexible inductor according to a seventh aspect of the present disclosure includes a coil substrate having a spiral conductor on at least one of an upper surface and a lower surface; and a first magnetic sheet laminated on the upper surface of the coil substrate and a second magnetic sheet laminated on the lower surface of the coil substrate. The coil substrate has a square lower surface with a pair of first sides opposing each other and a pair of second sides opposing each other, a first outer electrode that makes direct contact with the lower surface of the coil substrate and is electrically connected to an outermost end portion of the spiral conductor, a second outer electrode that makes direct contact with the lower surface of the coil substrate and is electrically connected to an innermost end portion of the spiral conductor, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate. The second magnetic sheet is laminated on the lower surface of the coil substrate other than portions corresponding to the first outer electrode, the second outer electrode, the third outer electrode, and the fourth outer electrode, and thicknesses of the first outer electrode, the second outer electrode, the third outer electrode, and the fourth outer electrode are equal to a thickness of the second magnetic sheet or are larger than the thickness of the second magnetic sheet. First reinforcing conductors extending along an extension direction of at least one of the first sides and the second sides are respectively connected to the third outer electrode and the fourth outer electrode.

With the above-described seventh aspect, the outer electrodes are directly provided on the coil substrate. Therefore, the coil substrate can be deformed while following deflection of the flexible substrate. Accordingly, the strength against deformation is increased and the resistance to mechanical impact can be increased. Furthermore, the first reinforcing conductors are respectively connected to the third outer electrode and the fourth outer electrode that are not connected to the spiral conductor. With this configuration, the stress that is applied to the interface between the coil substrate and the third outer electrode and/or the interface between the coil substrate and the fourth outer electrode is dispersed and moderated, thereby further increasing the strength against deflection.

According to an eighth aspect of the present disclosure, the first outer electrode is electrically connected to the outermost end portion of the spiral conductor with a first extended line extending along an extension direction of one of the first sides and the second sides interposed therebetween, and the second outer electrode is electrically connected to the innermost end portion of the spiral conductor with a second extended line extending along the extension direction of the one of the first sides and the second sides interposed therebetween. Also, second reinforcing conductors extend along the other extension direction of the first sides and the second sides are respectively connected to the first outer electrode and the second outer electrode, in the seventh aspect.

With the above-described eighth aspect, the second reinforcing conductors are provided. With this configuration, stress that is applied to the first extended line and the second extended line is dispersed and moderated, thereby further increasing the strength against deflection.

According to a ninth aspect of the present disclosure, the first outer electrode is electrically connected to the outermost end portion of the spiral conductor with a first extended line extending along an extension direction of one of the first sides and the second sides interposed therebetween, and the second outer electrode is electrically connected to the innermost end portion of the spiral conductor with a second extended line extending along the extension direction of the one of the first sides and the second sides interposed therebetween. At least one of the first extended line and the second extended line has a third reinforcing conductor that is formed by a plurality of band-like conductors arranged in parallel with one another and in which the adjacent band-like conductors are connected to each other at both ends of the plurality of band-like conductors, in the seventh aspect.

With the above-described ninth aspect, the third reinforcing conductor that is formed by the plurality of band-like conductors is connected to the outer electrode. With this configuration, the plurality of band-like conductors are easy to be deformed and the stress that is applied to the coil substrate and the outer electrode can therefore be further dispersed and moderated.

According to a tenth aspect of the present disclosure, one or a plurality of cutout portions are formed on the coil substrate in the vicinity of at least one outer electrode selected from the first outer electrode, the second outer electrode, the third outer electrode, and the fourth outer electrode, in the seventh aspect. With the tenth aspect, the cutout portion is provided in the vicinity of the outer electrode. With this configuration, the coil substrate is easy to be deformed in the vicinity of the cutout portion. Therefore, the stress that is applied to the coil substrate and the outer electrode can be further dispersed and moderated.

According to an eleventh aspect of the present disclosure, the first reinforcing conductors extend along extension directions of both of the first sides and the second sides, in the seventh aspect. With the eleventh aspect, the first reinforcing conductors extend along the extension directions of both of the first sides and the second sides. With this configuration, the stress that is applied to the interface between the coil substrate and the third outer electrode and/or the interface between the coil substrate and the fourth outer electrode can be further dispersed and moderated.

A flexible inductor according to a twelfth aspect of the present disclosure includes a coil substrate having a spiral conductor on at least one of an upper surface and a lower surface; and a first magnetic sheet laminated on the upper surface of the coil substrate and a second magnetic sheet laminated on the lower surface of the coil substrate. The coil substrate has a square lower surface with a pair of first sides opposing each other and a pair of second sides opposing each other, a first outer electrode that makes direct contact with the lower surface of the coil substrate and is electrically connected to an outermost end portion of the spiral conductor, a second outer electrode that makes direct contact with the lower surface of the coil substrate and is electrically connected to an innermost end portion of the spiral conductor, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate. First reinforcing conductors extending along an extension direction of at least one of the first sides and the second sides are respectively connected to the third outer electrode and the fourth outer electrode.

With the above-described twelfth aspect, the first reinforcing conductors are respectively connected to the third outer electrode and the fourth outer electrode that are not connected to the spiral conductor. With this configuration, the stress that is applied to the interface between the coil substrate and the third outer electrode and/or the interface between the coil substrate and the fourth outer electrode can be dispersed and moderated. Furthermore, the outer electrodes are directly provided on the coil substrate. Therefore, the coil substrate can be deformed while following deflection of the flexible substrate. Accordingly, the strength against deformation is increased and the resistance to mechanical impact such as drop can be increased.

According to a thirteenth aspect of the present disclosure, the first outer electrode is electrically connected to the outermost end portion of the spiral conductor with a first extended line extending along an extension direction of one of the first sides and the second sides interposed therebetween, and the second outer electrode is electrically connected to the innermost end portion of the spiral conductor with a second extended line extending along the extension direction of the one of the first sides and the second sides interposed therebetween. Second reinforcing conductors extending along the other extension direction of the first sides and the second sides are respectively connected to the first outer electrode and the second outer electrode, in the twelfth aspect.

With the above-described thirteenth aspect, the second reinforcing conductors are provided. With this configuration, the stress that is applied to the first extended line and the second extended line can be dispersed and moderated.

According to a fourteenth aspect of the present disclosure, the first outer electrode is electrically connected to the outermost end portion of the spiral conductor with a first extended line extending along an extension direction of one of the first sides and the second sides interposed therebetween, and the second outer electrode is electrically connected to the innermost end portion of the spiral conductor with a second extended line extending along the extension direction of the one of the first sides and the second sides interposed therebetween. At least one of the first extended line and the second extended line has a third reinforcing conductor that is formed by a plurality of band-like conductors arranged in parallel with one another and in which the adjacent band-like conductors are connected to each other at both ends of the plurality of band-like conductors, in the twelfth aspect.

With the above-described fourteenth aspect, the third reinforcing conductor that is formed by the plurality of band-like conductors is connected to the outer electrode. With this configuration, the plurality of band-like conductors are easy to be deformed and the stress that is applied to the coil substrate and the outer electrode can therefore be further dispersed and moderated.

According to a fifteenth aspect of the present disclosure, one or a plurality of cutout portions are formed on the coil substrate in the vicinity of at least one outer electrode selected from the first outer electrode, the second outer electrode, the third outer electrode, and the fourth outer electrode, in the twelfth aspect. With the fifteenth aspect, the cutout portion is provided in the vicinity of the outer electrode. With this configuration, the coil substrate is easy to be deformed in the vicinity of the cutout portion. Therefore, the stress that is applied to the coil substrate and the outer electrode can be further dispersed and moderated.

According to a sixteenth aspect of the present disclosure, the first reinforcing conductors extend along extension directions of both of the first sides and the second sides, in the twelfth aspect. With the sixteenth aspect, the first reinforcing conductors extend along the extension directions of both of the first sides and the second sides. With this configuration, the stress that is applied to the interface between the coil substrate and the third outer electrode and/or the interface between the coil substrate and the fourth outer electrode can be further dispersed and moderated.

The present disclosure can provide a flexible inductor that can be deformed while following deflection of a flexible substrate over time when the flexible inductor is mounted on the flexible substrate, and has high resistance to mechanical impact.

DESCRIPTION OF EMBODIMENTS

Hereinafter, embodiments of the present disclosure will be described with reference to the accompanying drawings.

First Embodiment

A flexible inductor according to the embodiment includes a coil substrate having a spiral conductor on at least one of an upper surface and a lower surface, and a first magnetic sheet laminated on the upper surface of the coil substrate and a second magnetic sheet laminated on the lower surface of the coil substrate. A first outer electrode that makes direct contact with the lower surface of the coil substrate and is electrically connected to an outermost end portion of the spiral conductor, and a second outer electrode that makes direct contact with the lower surface of the coil substrate and is electrically connected to an innermost end portion of the spiral conductor, are provided in a peripheral edge portion of the lower surface of the coil substrate and the second magnetic sheet is laminated on the lower surface of the coil substrate other than portions corresponding to the first outer electrode and the second outer electrode. The thicknesses of the first outer electrode and the second outer electrode are equal to a thickness of the second magnetic sheet or are larger than the thickness of the second magnetic sheet.

Figure 1:
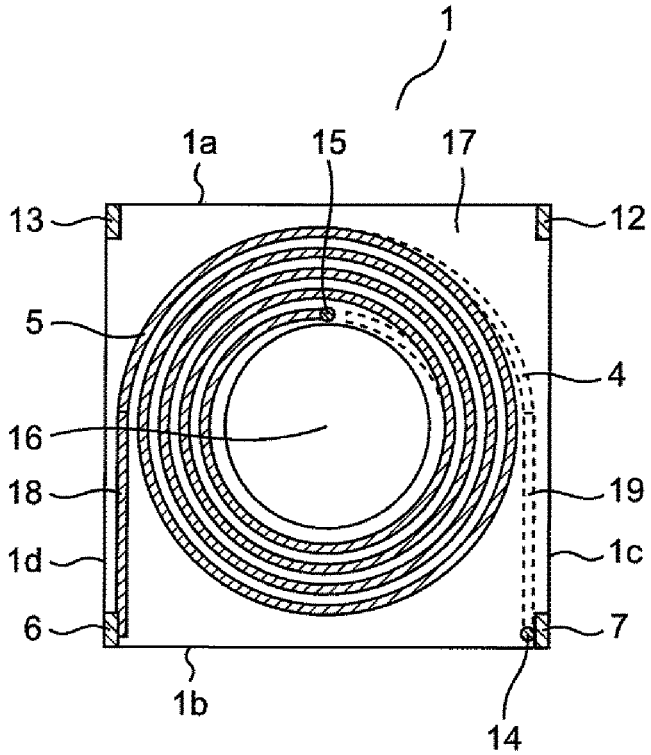
FIG. 1 is a bottom view illustrating an example of the configuration of a coil substrate configuring a flexible inductor according to a first embodiment of the present disclosure.

FIG. 1 is a bottom view illustrating an example of the configuration of the coil substrate configuring the flexible inductor in the embodiment. A coil substrate 1 includes a rectangular-shaped flexible board 17 having a cavity 16 in the vicinity of a center, a spiral conductor 4 formed on the upper surface of the flexible board 17, a spiral conductor 5 formed on the lower surface of the flexible board 17, and outer electrodes 6, 7, 12, and 13 formed in four corners of a peripheral edge portion of the lower surface. The coil substrate has a square lower surface with a pair of first sides 1*a* and 1*b* opposing each other and a pair of second sides 1*c* and 1*d* opposing each other. An outermost end portion of the spiral conductor 5 in the radial direction is electrically connected to the first outer electrode 6 with a first extended line 18 interposed therebetween. An innermost end portion of the spiral conductor 5 in the radial direction is electrically connected to an innermost end portion of the spiral conductor 4 in the radial direction with a via conductor 15 penetrating through the flexible board 17 interposed therebetween and an outermost end portion of the spiral conductor 4 in the radial direction is electrically connected to the second outer electrode 7 with a via conductor 14 penetrating through the flexible board 17 and a second extended line 19 interposed therebetween. It should be noted that the third outer electrode 12 and the fourth outer electrode 13 are not connected to the spiral conductors 4 or 5. The outer electrodes are required to be provided at the four corners in order to keep stretchability in both of an X direction (direction in which one side of the pair of opposing sides of the flexible board 17 extends in a paper plane, both of the first outer electrode 6 and the second outer electrode 7 making contact with the one side) and a Y direction (direction orthogonal to the X direction in the paper plane) even when a flexible substrate on which the flexible inductor is mounted is bent in any of the directions. For this reason, the outer electrodes are formed in the above-described manner.

Figure 2A:
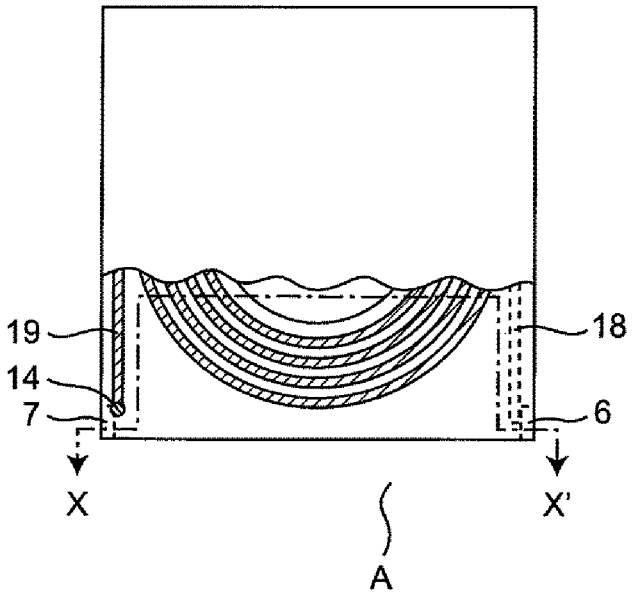
FIG. 2A is a partial cutout plan view of the flexible inductor including the coil substrate illustrated in FIG. 1.
Figure 2B:
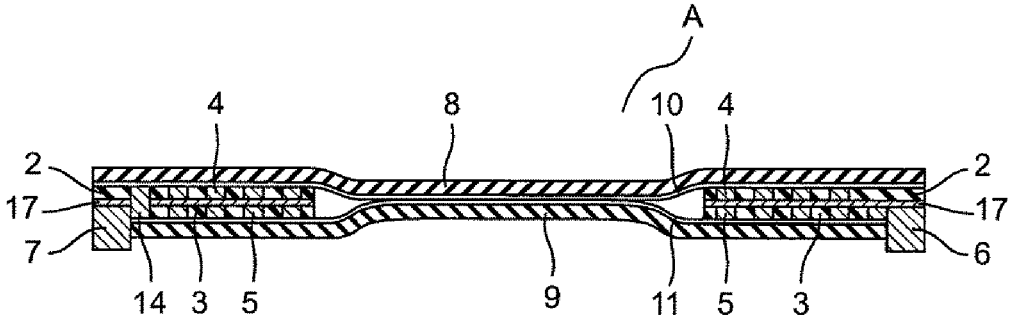
FIG. 2B is a longitudinal cross-sectional view cut along line X-X' in FIG. 2A.

FIG. 2A is a partial cutout plan view of the flexible inductor including the coil substrate illustrated in FIG. 1. FIG. 2B is a longitudinal cross-sectional view cut along line X-X' in FIG. 2A. A flexible inductor A includes the coil substrate 1, a first magnetic sheet 8 laminated on the upper surface of the coil substrate 1, and a second magnetic sheet 9 laminated on the lower surface of the coil substrate 1. The first magnetic sheet 8 and the second magnetic sheet 9 are bonded to the coil substrate 1 using an adhesive layer 10 and an adhesive layer 11, respectively. Spaces in the spiral conductor 5 are filled with insulating resin 2 and spaces in the spiral conductor 4 are filled with insulating resin 3. The first outer electrode 6 and the second outer electrode 7 are formed in the peripheral edge portion of the lower surface of the coil substrate 1 and the second magnetic sheet 9 is laminated on the lower surface of the coil substrate 1 other than portions corresponding to the first outer electrode 6 and the second outer electrode 7. The thicknesses of the first outer electrode 6 and the outer electrode 7 are larger than the thickness of the second magnetic sheet 9.

An insulating resin film or a composite resin film having flexibility can be used for the flexible board configuring the coil substrate 1, and examples thereof can include glass epoxy resin, polyimide, polyethylene naphthalate, and the like. As a shape of the flexible board, a rectangular shape of equal to or larger than 5 mm×5 mm and equal to or smaller than 20 mm×20 mm (i.e., from 5 mm×5 mm to 20 mm×20 mm) can be employed. Furthermore, the thickness of the flexible board is equal to or larger than 10 μm and equal to or smaller than 100 μm (i.e., from 10 to 100 μm), and preferably, equal to or larger than 40 μm and equal to or smaller than 70 μm (i.e., from 40 to 70 μm).

The spiral conductor can be formed by forming a predetermined spiral pattern on a metal layer formed on the flexible board by a photolithography method and performing etching processing thereon. The metal layer can be formed by forming a metal film on the flexible board using a plating method or laminating metal foil on the flexible board. Copper or silver excellent in conductivity can be used for the conductor. The spiral conductor can be formed on the upper surface or the lower surface of the flexible board or on each of the upper surface and the lower surface thereof. When the spiral conductor is formed on each of the upper surface and the lower surface, as illustrated in FIG. 1, the outermost end portion of the spiral conductor 5 in the radial direction is electrically connected to the first outer electrode 6, the innermost end portion of the spiral conductor 5 in the radial direction is electrically connected to the innermost end portion of the spiral conductor 4 in the radial direction with the via conductor 15 penetrating through the flexible board 17 interposed therebetween, and the outermost end portion of the spiral conductor 4 in the radial direction is electrically connected to the second outer electrode 7 with the via conductor 14 penetrating through the flexible board 17 interposed therebetween. On the other hand, when the spiral conductor is formed on one of the upper surface and the lower surface, for example, when the spiral conductor is formed on the lower surface, as is described with reference to FIG. 1, the outermost end portion of the spiral conductor 5 in the radial direction is electrically connected to the first outer electrode 6 with the first extended line 18 interposed therebetween, the innermost end portion of the spiral conductor 5 in the radial direction is electrically connected to the second extended line 19 with the via conductor 15 penetrating through the flexible board 17 interposed therebetween, and the second extended line is electrically connected to the second outer electrode 7.

As the insulating resin filling the spaces in the spiral conductor, a thermosetting resin sheet, for example, an epoxy resin sheet can be used. When the epoxy resin sheet is pressure-bonded to the coil substrate, the epoxy resin sheet can be fluidized, fill the spaces in the spiral conductor, and be hardened.

The thicknesses of the outer electrodes are equal to the thickness of the magnetic sheet laminated on the lower surface of the coil substrate or are larger than the thickness of the magnetic sheet. The thicknesses are set in the above-described manner in order to easily make the outer electrodes close contact with the flexible substrate. For example, when the thickness of the magnetic sheet is 100 μm, the thicknesses of the outer electrodes are equal to or larger than 100 μm and equal to or smaller than 150 μm (i.e., from 100 to 150 μm), and preferably, equal to or larger than 100 μm and equal to or smaller than 120 μm (i.e., from 120 to 150 μm). The outer electrodes can be directly formed on the coil substrate using a plating method. FIG. 1 illustrates the example in which the outer electrodes are provided at the four corners of the rectangular coil substrate, and two of them are not connected to the spiral coils. As described above, the outer electrodes are provided at the four corners in order to keep the stretchability in both of the X direction and the Y direction even when the flexible substrate on which the inductor is mounted is bent in any of the directions. If the bending direction of the flexible substrate on which the inductor is mounted can be limited to one direction, the number of outer electrodes can also be set to two. When the bending direction of the flexible substrate can be limited to the X direction, for example, one band-like conductor is formed by causing the first outer electrode 6 and the fourth outer electrode 13 to extend along the side with which both of the first outer electrode 6 and the fourth outer electrode 13 make contact such that the first outer electrode 6 and the fourth outer electrode 13 are continuous to each other whereas another band-like conductor is formed by causing the second outer electrode 7 and the third outer electrode 12 to extend along the side with which both of the second outer electrode 7 and the third outer electrode 12 make contact such that the second outer electrode 7 and the third outer electrode 12 are continuous to each other.

As the magnetic sheet, an anisotropic composite magnetic sheet formed by dispersing flattened soft magnetic metal powder in binder resin and aligning the soft magnetic metal powder such that a major axis direction thereof is directed to an in-plane direction of the sheet can be used. The soft magnetic metal powder is not particularly limited as long as it contains iron as a main component. The magnetic sheet is required to have heat resistance capable of being subject to solder reflow and, for example, silicone resin, epoxy resin, or the like as flexible resin having heat resistance can be used for the binder resin. When the magnetic sheet is laminated on the coil substrate, it is bonded to the coil substrate by forming the adhesive layer on the surface of the magnetic sheet. Therefore, as the adhesive layer, one having heat resistance capable of being subject to the solder reflow is used. The thickness of the magnetic sheet is equal to or larger than 30 μm and equal to or smaller than 200 μm (i.e., from 30 to 300 μm), and preferably, equal to or larger than 50 μm and equal to or smaller than 100 μm (i.e., from 50 to 100 μm).

As a method for aligning the soft magnetic metal powder such that the major axis direction thereof is directed to the in-plane direction of the sheet, a well-known method such as a doctor blade method, a screen printing method, a spray application method, and a heat press method as disclosed in Japanese Unexamined Patent Application Publication No. 2009-9985 can be used.

In the present disclosure, the first magnetic sheet that is laminated on the upper surface of the coil substrate and the second magnetic sheet that is laminated on the lower surface of the coil substrate are used. Through-holes, cutouts, and the like in accordance with the shapes of the outer electrodes are required to be provided in the second magnetic sheet because the second magnetic sheet needs to be laminated on the lower surface of the coil substrate other than the portions corresponding to the outer electrodes.

Hereinafter, a method for manufacturing the flexible inductor in the embodiment will be described.

FIGS. 3A to 3I are schematic cross-sectional views illustrating an example of a manufacturing process. A process (a) illustrated in FIG. 3A, a glass epoxy resin film is prepared as a flexible board 20 and through-holes are formed therein at predetermined positions.

Figure 3A:
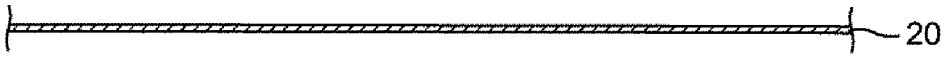
FIG. 3A is a schematic cross-sectional view illustrating an example of a manufacturing process of the flexible inductor in the first embodiment of the present disclosure.
Figure 3B:
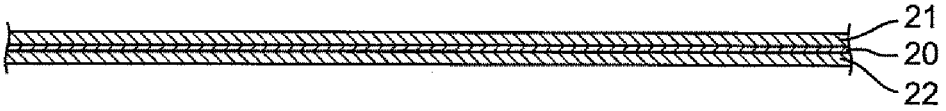
FIG. 3B is a schematic cross-sectional view illustrating an example of the manufacturing process of the flexible inductor in the first embodiment of the present disclosure.

In a process (b) illustrated in FIG. 3B, copper plating is performed on both of a pair of facing main surfaces (hereinafter, referred to as an upper surface and a lower surface) of the flexible board 20 overall to form copper layers 21 and 22. A via conductor for an innermost end portion (not illustrated) is thereby formed in the through-hole.

Figure 3C:
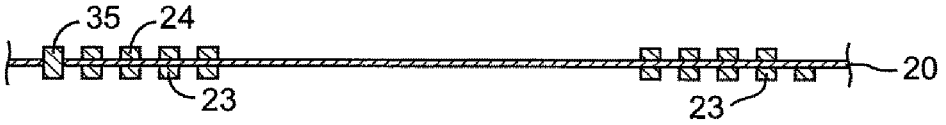
FIG. 3C is a schematic cross-sectional view illustrating an example of the manufacturing process of the flexible inductor in the first embodiment of the present disclosure.

In a process (c) in FIG. 3C, resist layers are formed on both of the upper surface and the lower surface of the flexible board 20 on which the copper layers 21 and 22 have been formed and etching processing is performed thereon to form a spiral conductor 24 on the upper surface of the flexible board 20 and a spiral conductor 23 on the lower surface thereof. Any one of a start point and an end point of the spiral conductor 24 on the upper surface is located in the vicinity of the center of the flexible board 20 and is connected to the spiral conductor 23 on the lower surface by providing the above-described via conductor for the innermost end portion (not illustrated) at this position. The spiral conductor on the upper surface and the spiral conductor on the lower surface are connected to each other by this method to form one spiral conductor having a so-called substantially α-wound shape. A via conductor 35 is integrated with an outermost end portion of the spiral conductor 24 in the radial direction and is electrically connected to a second outer electrode 29, which will be described later.

Figure 3D:
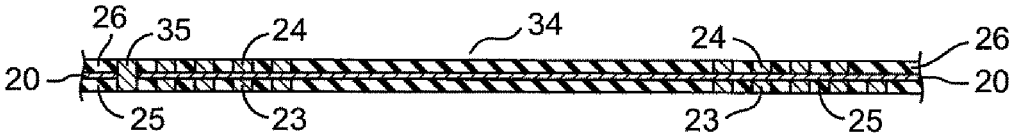
FIG. 3D is a schematic cross-sectional view illustrating an example of the manufacturing process of the flexible inductor in the first embodiment of the present disclosure.

In a process (d) illustrated in FIG. 3D, insulating resin sheets, for example, epoxy resin sheets are pressure-bonded to both of the upper surface and the lower surface of the flexible board 20 to form a coil substrate 34 in which spaces in the spiral conductors are filled with insulating resin. The spaces in the spiral conductor 23 on the lower surface are filled with insulating resin 25 and the spaces in the spiral conductor 24 on the upper surface are filled with insulating resin 26.

Figure 3E:
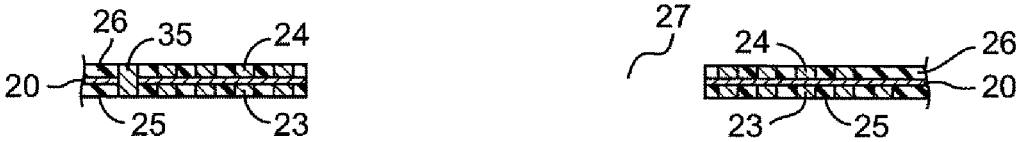
FIG. 3E is a schematic cross-sectional view illustrating an example of the manufacturing process of the flexible inductor in the first embodiment of the present disclosure.

In a process (e) illustrated in FIG. 3E, a center portion of the coil substrate 34 is cut out by blast processing or the like to provide a cavity 27.

Figure 3F:
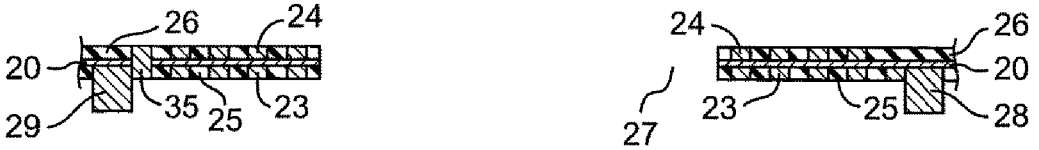
FIG. 3F is a schematic cross-sectional view illustrating an example of the manufacturing process of the flexible inductor in the first embodiment of the present disclosure.

In a process (f) illustrated in FIG. 3F, the outer electrodes are formed in four corners of the coil substrate 34 by a plating method. The thicknesses of the outer electrodes are set to be equal to or larger than the thickness of a magnetic sheet, which will be bonded later. An innermost end portion of the spiral conductor 24 in the radial direction is connected to an innermost end portion of the spiral conductor 23 on the lower surface in the radial direction with the via conductor for the innermost end portion (not illustrated) penetrating through the flexible board 20 interposed therebetween. The outermost end portion of the spiral conductor 24 in the radial direction is electrically connected to the second outer electrode 29 with the via conductor 35 penetrating through the flexible board 20 interposed therebetween. An outermost end portion of the spiral conductor 23 in the radial direction is electrically connected to a first outer electrode 28.

Figure 3G:
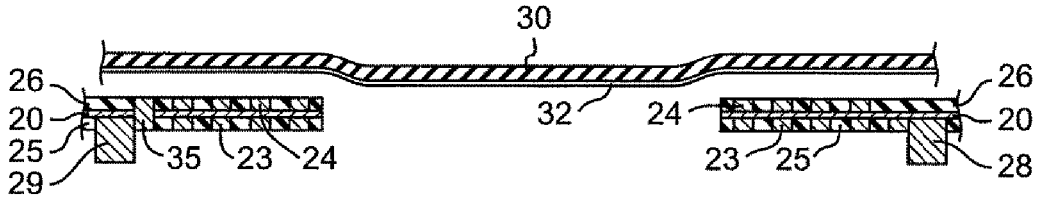
FIG. 3G is a schematic cross-sectional view illustrating an example of the manufacturing process of the flexible inductor in the first embodiment of the present disclosure.

In a process (g) illustrated in FIG. 3G, a first magnetic sheet 30 formed by an anisotropic composite magnetic sheet and having an adhesive layer 32 is bonded to and laminated on the upper surface of the coil substrate 34.

Figure 3H:
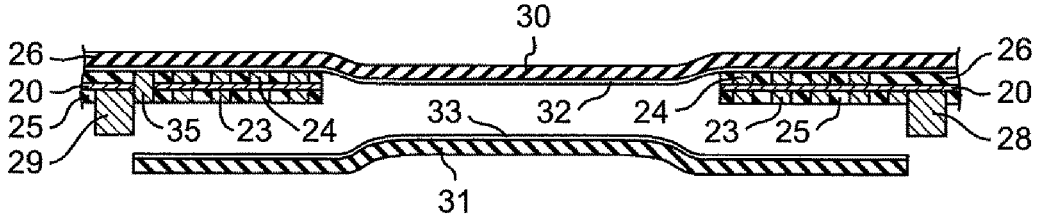
FIG. 3H is a schematic cross-sectional view illustrating an example of the manufacturing process of the flexible inductor in the first embodiment of the present disclosure.

In a process (h) illustrated in FIG. 3H, a second magnetic sheet 31 formed by an anisotropic composite magnetic sheet and having an adhesive layer 33 is bonded to and laminated on the lower surface of the coil substrate 34. The second magnetic sheet 31 is provided with cutout portions in four corners thereof and is laminated so as to cover the lower surface of the coil substrate other than portions corresponding to the four outer electrodes. The first magnetic sheet 30 and the second magnetic sheet 31 are directly bonded to each other in the cavity 27.

Figure 3I:
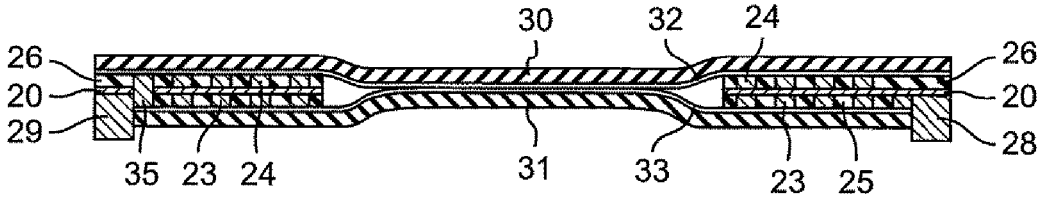
FIG. 3I is a schematic cross-sectional view illustrating an example of the manufacturing process of the flexible inductor in the first embodiment of the present disclosure.

In a process (i) illustrated in FIG. 3I, a mother sheet including a large number of flexible inductors is divided into individual pieces to provide the individual flexible inductors.

In the flexible inductor in the embodiment, the outer electrodes are directly provided on the coil substrate. Therefore, the coil substrate can be deformed while following deflection of the flexible substrate. Accordingly, strength against deformation is increased and resistance to mechanical impact such as drop can be increased.

Second Embodiment

The flexible inductor in which the outer electrodes are formed as integrated electrodes has been described as an example in the first embodiment. A flexible inductor in the embodiment alternatively uses assemblies of a plurality of conductors as outer electrodes, and has the same configuration as that in the first embodiment other than this point.

Figure 4A:
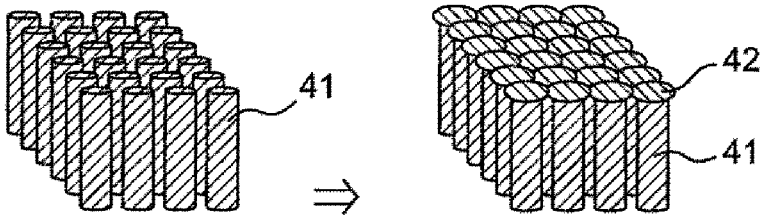
FIG. 4A is a schematic perspective view illustrating the configuration of an outer electrode of a flexible inductor according to a second embodiment of the present disclosure.

The plurality of conductors can be made of a metal material, for example, copper, which has a columnar shape, a prism shape, a plate-like shape, or the like. Preferably, copper having the columnar shape or the plate-like shape can be used. FIG. 4A is a schematic view illustrating an example of the assembly of the columnar conductors and hat-like conductor portions 42 are formed on tops of columnar conductors 41.

Figure 4B:
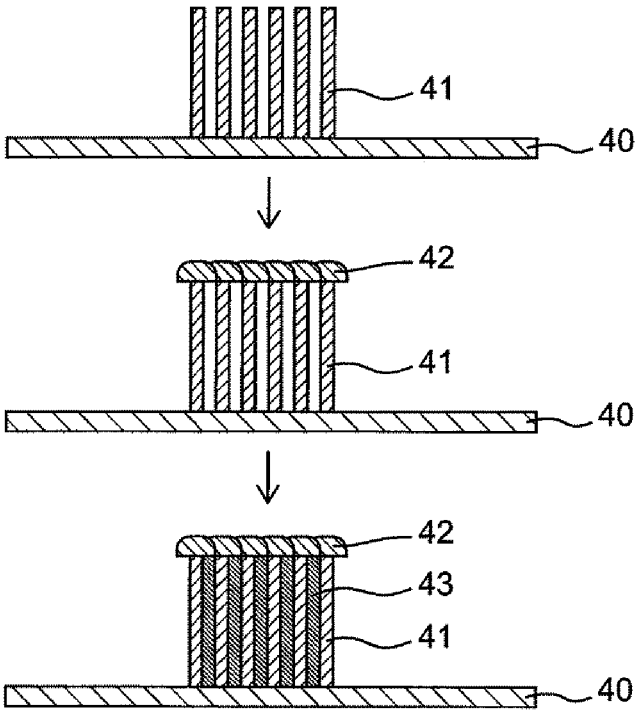
FIG. 4B is a schematic cross-sectional view illustrating an example of a manufacturing process of the flexible inductor in the second embodiment of the present disclosure.

The assembly of the plurality of conductors can be formed using a photolithography method and a plating method. FIG. 4B is a schematic cross-sectional view illustrating an example of a manufacturing process of the assembly of the columnar conductors. For example, a plurality of columnar holes are formed in a photosensitive resin layer (not illustrated) on a coil substrate 40 and the portions are filled with plating to form the columnar conductors 41. The plating spreads in a hat-like manner from the height higher than the photosensitive resin layer (not illustrated) and individual hat portions are integrated to form the hat-like conductors 42. Thereafter, the assembly of the columnar conductors can be provided by removing the photosensitive resin layer. Furthermore, spaces in the assembly may be filled with flexible insulating resin 43, for example, silicone rubber if necessary. When the plate-like conductors are formed, it is sufficient that a plurality of plate-like holes are formed in the photosensitive resin layer. When the columnar conductors are formed, the sizes, for example, the diameters thereof are equal to or larger than 20 μm and equal to or smaller than 50 μm (i.e., from 20 to 50 μm), and preferably, equal to or larger than 30 μm and equal to or smaller than 40 μm (i.e., from 30 to 40 μm). The heights of the columnar conductors including the hat-like conductor portions are equal to or larger than 50 μm and equal to or smaller than 150 μm (i.e., from 50 to 150 μm), and preferably, equal to or larger than 100 μm and equal to or smaller than 120 μm (i.e., from 100 to 120 μm).

The embodiment provides the same effects as those in the first embodiment. Furthermore, in the embodiment, the outer electrodes are configured by the assemblies of the plurality of conductors. With this configuration, the outer electrodes are easy to be deformed when receiving stress. Therefore, stress that is applied to the coil substrate can be further dispersed. Solder does not enter the spaces of the assemblies of the conductors in soldering by filling the spaces in the assemblies of the conductors with the flexible insulating resin. This prevents deformation of the outer electrodes in the lateral direction from being inhibited by the solder hardened in the spaces of the assemblies. Accordingly, the effect that the outer electrodes are easy to be deformed even when receiving the stress can be provided.

Third Embodiment

The flexible inductor in which no cutout portion is formed in the coil substrate has been described as an example in the first embodiment. A flexible inductor in the embodiment is alternatively provided with one or a plurality of cutout portions in the vicinity of at least one of the first outer electrode and the second outer electrode, and has the same configuration as that in the first embodiment other than this point.

Figure 5:
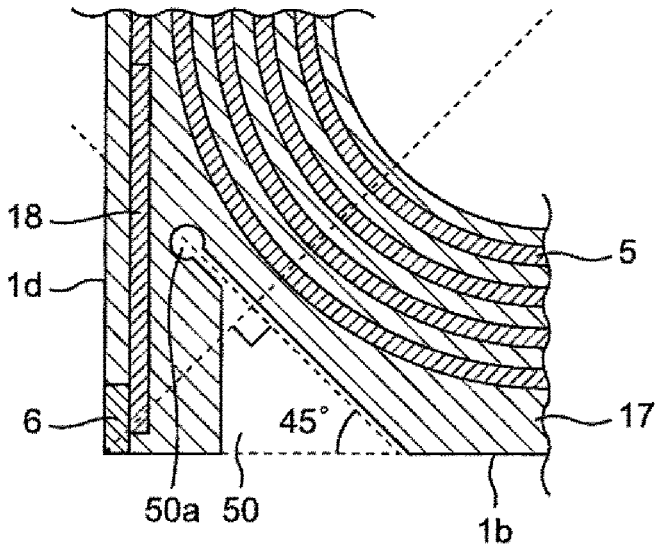
FIG. 5 is a partial bottom view illustrating an example of the configuration of a coil substrate configuring a flexible inductor according to a third embodiment of the present disclosure.

FIG. 5 is a partial bottom view illustrating a coil substrate configuring the flexible inductor in the embodiment. The spiral conductor 5 is formed on the lower surface of the flexible board 17 and the first outer electrode 6 is electrically connected to the outermost end portion of the spiral conductor 5 in the radial direction with the first extended line 18 interposed therebetween. A cutout portion 50 formed by cutting the coil substrate is provided in the vicinity of the first outer electrode 6. The cutout portion 50 is formed by cutting the coil substrate along a cutout direction with 45 degrees with respect to the second side 1*b* (horizontal side) of the first side 1*d* (vertical side) and the second side 1*b* (horizontal side) forming a lower surface corner portion of the coil substrate at which the first outer electrode 6 is located. A front end portion 50*a* of the cutout portion 50 has an R shape. FIG. 5 illustrates the example of the cutout direction with 45 degrees with respect to the horizontal side of the vertical side and the horizontal side forming the lower surface corner portion of the coil substrate at which the first outer electrode is located. Alternatively, any angle in a range in which the cutout portion does not make contact with the spiral conductor can be used.

Figure 6:
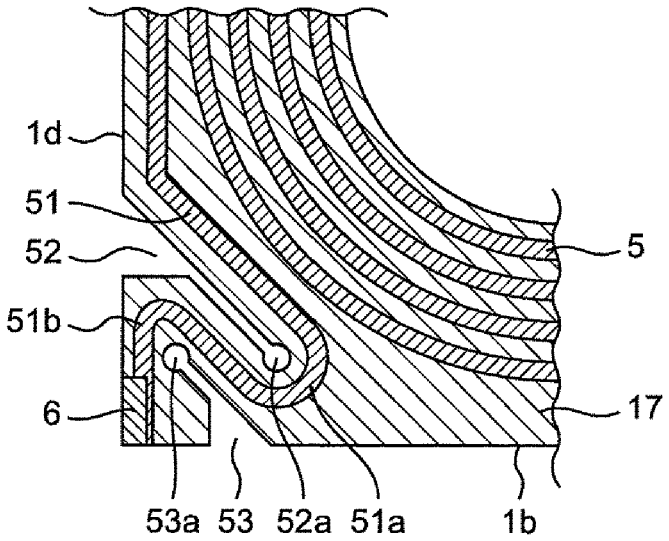
FIG. 6 is a partial bottom view illustrating another example of the configuration of the coil substrate configuring the flexible inductor in the third embodiment of the present disclosure.

FIG. 6 is a partial bottom view illustrating another coil substrate configuring the flexible inductor in the embodiment, and two cutout portions 52 and 53 are provided in the vicinity of the first outer electrode 6. A first extended line 51 extending in a meander-like manner is provided at the outermost end portion of the spiral conductor 5 in the radial direction, and the first extended line 51 is electrically connected to the first outer electrode 6. The meander-like extended line 51 has two curved portions 51*a* and 51*b*. The cutout portion 52 is formed by cutting the coil substrate along a cutout direction with 45 degrees with respect to the first side 1*d* (vertical side) of the first side 1*d* (vertical side) and the second side 1*b* (horizontal side) forming the lower surface corner portion of the coil substrate at which the first outer electrode 6 is located. A front end portion 52*a* of the cutout portion 52 has an R shape. The cutout portion 53 is formed by cutting the coil substrate along a cutout direction with 45 degrees with respect to the second side 1*b* (horizontal side) of the first side 1*d* (vertical side) and the second side 1*b* (horizontal side) forming the lower surface corner portion of the coil substrate at which the first outer electrode 6 is located. A front end portion 53*a* of the cutout portion 53 has an R shape. Although FIG. 6 illustrates the example in which the two cutout portions are provided, more cutout portions can also be provided.

The embodiment provides the same effects as those in the first embodiment. Furthermore, in the embodiment, one or the plurality of cutout portions are provided in the vicinity of at least one of the first outer electrode and the second outer electrode. With this configuration, the coil substrate is easy to be deformed in the vicinity of the cutout portion. Therefore, the stress that is applied to the coil substrate and the first outer electrode and/or the second outer electrode can be further dispersed and moderated. Moreover, the front end portion of the cutout portion in the cutout direction is formed to have the R shape. With this configuration, the stress that is applied to the coil substrate and the first outer electrode and/or the second outer electrode can be further dispersed and moderated.

Fourth Embodiment

A flexible inductor in the embodiment includes a coil substrate having a spiral conductor on at least one of an upper surface and a lower surface, and a first magnetic sheet laminated on the upper surface of the coil substrate and a second magnetic sheet laminated on the lower surface of the coil substrate. The coil substrate has a square lower surface with a pair of first sides opposing each other and a pair of second sides opposing each other, a first outer electrode that makes direct contact with the lower surface of the coil substrate and is electrically connected to an outermost end portion of the spiral conductor, a second outer electrode that makes direct contact with the lower surface of the coil substrate and is electrically connected to an innermost end portion of the spiral conductor, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate. The second magnetic sheet is laminated on the lower surface of the coil substrate other than portions corresponding to the first outer electrode, the second outer electrode, the third outer electrode, and the fourth outer electrode, and thicknesses of the first outer electrode, the second outer electrode, the third outer electrode, and the fourth outer electrode are equal to a thickness of the second magnetic sheet or are larger than the thickness of the second magnetic sheet. First reinforcing conductors extending along an extension direction of at least one of the first sides and the second sides are respectively connected to the third outer electrode and the fourth outer electrode.

The flexible inductor in the embodiment has the same configuration as that in the first embodiment other than a point that the first reinforcing conductors extending along the extension direction of at least one of the first sides and the second sides are respectively connected to the third outer electrode and the fourth outer electrode.

Figure 7:
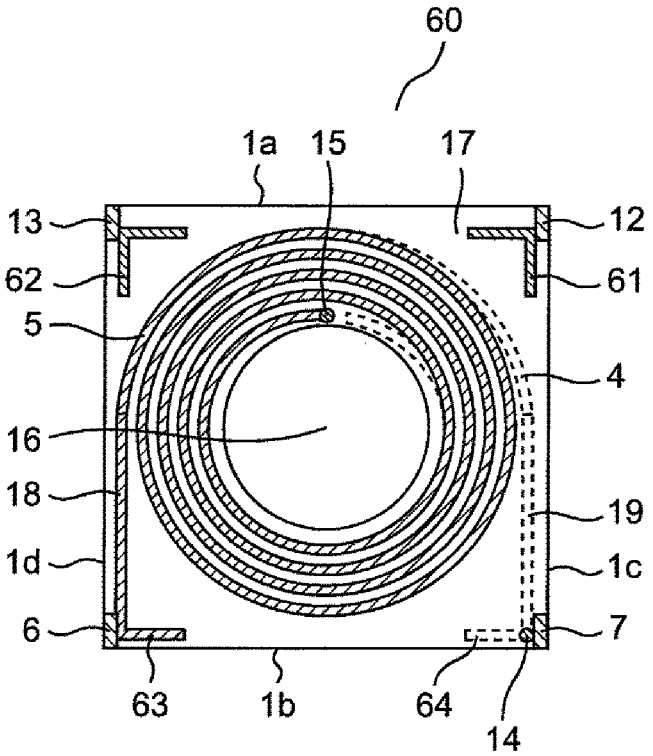
FIG. 7 is a bottom view illustrating an example of the configuration of a coil substrate configuring a flexible inductor according to a fourth embodiment of the present disclosure.

FIG. 7 is a bottom view illustrating an example of the configuration of a coil substrate configuring the flexible inductor in the embodiment. A coil substrate 60 has a square lower surface with the pair of first sides 1*a* and 1*b* opposing each other and the pair of second sides 1*c* and 1*d* opposing each other. First reinforcing conductors 61 and 62 extending along the extension directions of both of the first side 1*a* and the second side 1*c* are respectively connected to the third outer electrode 12 and the fourth outer electrode 13. The first outer electrode 6 is electrically connected to the outermost end portion of the spiral conductor 5 with the first extended line 18 extending along the extension direction of the first side 1*d* interposed therebetween, and the second outer electrode 7 is electrically connected to the innermost end portion of the spiral conductor 5 with the second extended line 19 extending along the extension direction of the first side 1*c* interposed therebetween. Moreover, second reinforcing conductors 63 and 64 extending along the extension direction of the first side 1*b* are respectively connected to the first outer electrode 6 and the second outer electrode 7. The first reinforcing conductors and the second reinforcing conductors are made of conductive metal, and can be formed by a plating method, for example. To be specific, the first reinforcing conductors and the second reinforcing conductors can be formed together with the outer electrodes in the process illustrated in FIG. 3F in the first embodiment.

The embodiment provides the same effects as those in the first embodiment. Furthermore, in the embodiment, the first reinforcing conductors are provided for the third outer electrode and the fourth outer electrode. With this configuration, stress that is applied to an interface between the third outer electrode and the coil substrate and/or an interface between the fourth outer electrode and the coil substrate can be dispersed to the first reinforcing conductors. Furthermore, the second reinforcing conductors are provided for the first outer electrode and the second outer electrode. With this configuration, stress that is applied to the extended lines can be dispersed to the second reinforcing conductors and be moderated.

FIG. 7 illustrates the example in which the first reinforcing conductors extend in the extension directions of both of the first side and the second side. Alternatively, the first reinforcing conductors 61 and 62 may extend along the extension direction of only one of the first side 1*a* and the second side 1*c*. The widths and the lengths of the first reinforcing conductors 61 and 62 are not particularly limited as long as the first reinforcing conductors 61 and 62 do not make contact with the spiral conductor 5. Although FIG. 7 illustrates the example in which the second reinforcing conductors are provided for the first outer electrode and the second outer electrode, the second reinforcing conductors can be omitted if necessary.

Fifth Embodiment

Figure 8:
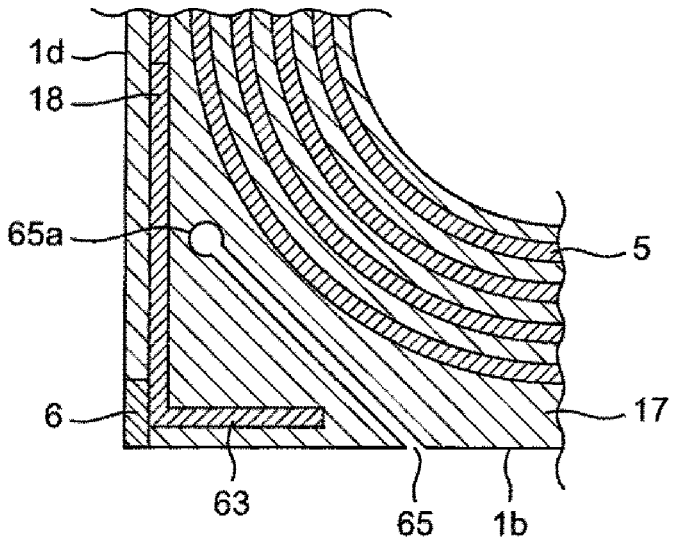
FIG. 8 is a partial bottom view illustrating an example of the configuration of a coil substrate configuring a flexible inductor according to a fifth embodiment of the present disclosure.

A flexible inductor in the embodiment has the same configuration as that in the fourth embodiment other than a point that one or a plurality of cutout portions are provided in the vicinity of at least one outer electrode. FIG. 8 is a partial bottom view illustrating a coil substrate configuring the flexible inductor in the embodiment. The spiral conductor 5 is formed on the lower surface of the flexible board 17 and the first outer electrode 6 is electrically connected to the outermost end portion of the spiral conductor 5 in the radial direction with the first extended line 18 interposed therebetween. The second reinforcing conductor 63 extending along the extension direction of the first side 1*b* is connected to the first outer electrode 6. A cutout portion 65 formed by cutting the coil substrate is provided in the vicinity of the first outer electrode 6. The cutout portion 65 is formed by cutting the coil substrate along a cutout direction with 45 degrees with respect to the second side 1*b* (horizontal side) of the first side 1*d* (vertical side) and the second side 1*b* (horizontal side) forming the lower surface corner portion of the coil substrate at which the first outer electrode 6 is located. A front end portion 65*a* of the cutout portion 65 has an R shape. FIG. 8 illustrates the example of the cutout direction with 45 degrees with respect to the horizontal side of the vertical side and the horizontal side forming the lower surface corner portion of the coil substrate at which the first outer electrode 6 is located. Alternatively, any angle in a range in which the cutout portion does not make contact with the spiral conductor can be used.

The embodiment provides the same effects as those in the fourth embodiment. Furthermore, the cutout portion is provided in the vicinity of the outer electrode. With this configuration, the coil substrate is easy to be deformed in the vicinity of the cutout portion. Therefore, the stress that is applied to the coil substrate and the outer electrode can be further dispersed and moderated. Moreover, the front end portion of the cutout portion in the cutout direction is formed to have the R shape. With this configuration, the stress that is applied to the coil substrate and the outer electrode can be further dispersed and moderated.

Although FIG. 8 illustrates the example in which the cutout portion is provided in the vicinity of the first outer electrode 6, the cutout portion can also be provided in the vicinity of the second outer electrode and in the vicinities of the third outer electrode and the fourth outer electrode. With the cutout portions, the stress that is applied to the coil substrate and the outer electrodes can be further dispersed and moderated.

Sixth Embodiment

A flexible inductor in the embodiment has the same configuration as that in the fifth embodiment other than a point that a third reinforcing conductor is connected to at least one outer electrode. The third reinforcing conductor is formed by a plurality of band-like conductors arranged in parallel with one another and the adjacent band-like conductors are connected to each other at both ends of the plurality of band-like conductors.

Figure 9:
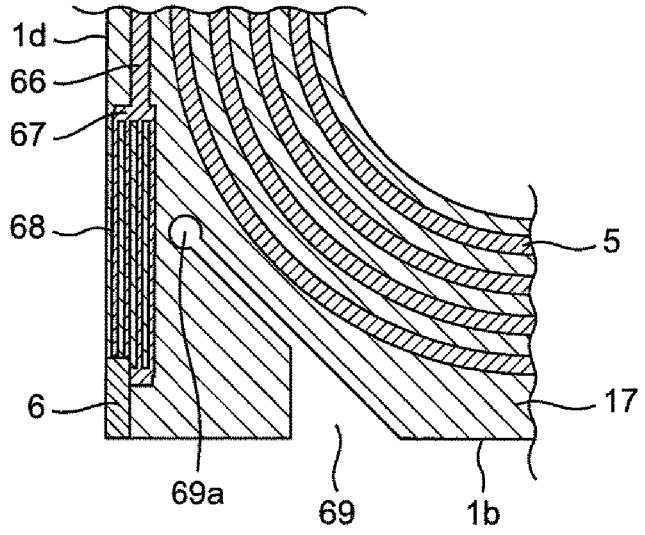
FIG. 9 is a partial bottom view illustrating an example of the configuration of a coil substrate configuring a flexible inductor according to a sixth embodiment of the present disclosure.

FIG. 9 is a partial bottom view illustrating a coil substrate configuring the flexible inductor in the embodiment. The spiral conductor 5 is formed on the lower surface of the flexible board 17 and the first outer electrode 6 is electrically connected to the outermost end portion of the spiral conductor 5 in the radial direction with a first extended line 66 interposed therebetween. The first extended line 66 has a third reinforcing conductor 67. The third reinforcing conductor 67 is formed by a plurality of band-like conductors 68 arranged in parallel with one another and the adjacent band-like conductors are connected to each other at both ends of the plurality of band-like conductors 68. A cutout portion 69 formed by cutting the coil substrate is provided in the vicinity of the first outer electrode 6. The cutout portion 69 is formed by cutting the coil substrate along a cutout direction with 45 degrees with respect to the second side 1*b* (horizontal side) of the first side 1*d* (vertical side) and the second side 1*b* (horizontal side) forming a lower surface corner portion of the coil substrate at which the first outer electrode 6 is located. A front end portion 69*a* of the cutout portion 69 has an R shape. The third reinforcing conductor is made of conductive metal, and can be formed by a plating method, for example. To be specific, the third reinforcing conductor can be formed together with the outer electrodes in the process illustrated in FIG. 3F in the first embodiment.

Spaces between the plurality of band-like conductors configuring the third reinforcing conductor are preferably filled with flexible insulating resin, for example, silicone rubber. This can prevent solder from entering the spaces between the plurality of band-like conductors in soldering.

The embodiment provides the same effects as those in the fifth embodiment. Furthermore, the third reinforcing conductor formed by the plurality of band-like conductors is connected to the outer electrode. With this configuration, the plurality of band-like conductors are easy to be deformed and the stress that is applied to the coil substrate and the outer electrode can therefore be further dispersed and moderated.

Seventh Embodiment

Figure 10:
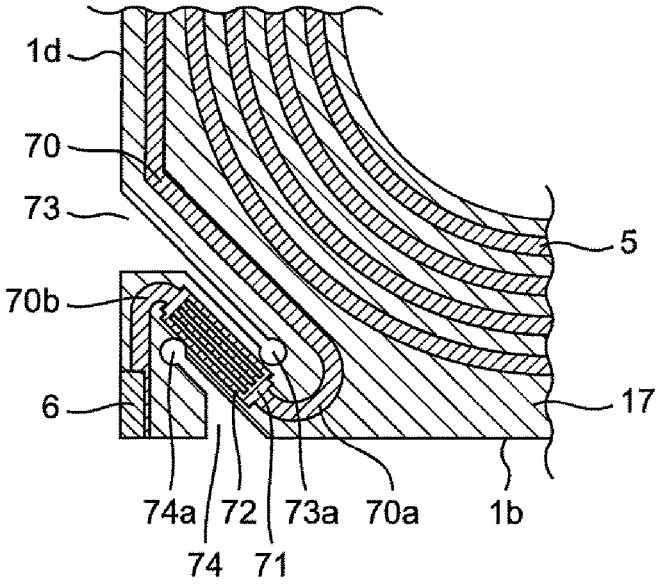
FIG. 10 is a partial bottom view illustrating an example of the configuration of a coil substrate configuring a flexible inductor according to a seventh embodiment of the present disclosure.

A flexible inductor in the embodiment has the same configuration as that in the sixth embodiment other than a point that a first extended line having a third reinforcing conductor is made to extend in a meander-like manner and is arranged along cutout portions. FIG. 10 is a partial bottom view illustrating a coil substrate configuring the flexible inductor in the embodiment, and two cutout portions 73 and 74 are provided in the vicinity of the first outer electrode 6. A first extended line 70 extending in the meander-like manner is provided at the outermost end portion of the spiral conductor 5 in the radial direction, and the first extended line 70 is electrically connected to the first outer electrode 6. The meander-like extended line 70 has two curved portions 70*a* and 70*b*. The two curved portions are coupled to each other with a third reinforcing conductor 71. The third reinforcing conductor 71 is formed by a plurality of band-like conductors 72 arranged in parallel with one another and the adjacent band-like conductors are connected to each other at both ends of the plurality of band-like conductors 72. The cutout portion 73 is formed by cutting the coil substrate along a cutout direction with 45 degrees with respect to the first side 1*d* (vertical side) of the first side 1*d* (vertical side) and the second side 1*b* (horizontal side) forming the lower surface corner portion of the coil substrate at which the first outer electrode 6 is located. A front end portion 73*a* of the cutout portion 73 has an R shape. The cutout portion 74 is formed by cutting the coil substrate along a cutout direction with 45 degrees with respect to the second side 1*b* (horizontal side) of the first side 1*d* (vertical side) and the second side 1*b* (horizontal side) forming the lower surface corner portion of the coil substrate at which the first outer electrode 6 is located. A front end portion 74*a* of the cutout portion 74 has an R shape.

A position of the third reinforcing conductor may be any position of the meander-like extended line but is preferably a position interposed between the two cutout portions, as illustrated in FIG. 10. The third reinforcing conductor is easier to be deformed by providing the third reinforcing conductor at the position.

The embodiment provides the same effects as those in the sixth embodiment. Furthermore, the first extended line having the third reinforcing conductor is made to extend in the meaner-like manner and is arranged along the cutout portions. With this configuration, the first extended line is easy to be deformed in both of the vertical direction and the horizontal direction and deformation of the first extended line enables the stress that is applied to the coil substrate and the outer electrode to be further dispersed and moderated.

Eighth Embodiment

Figure 11:
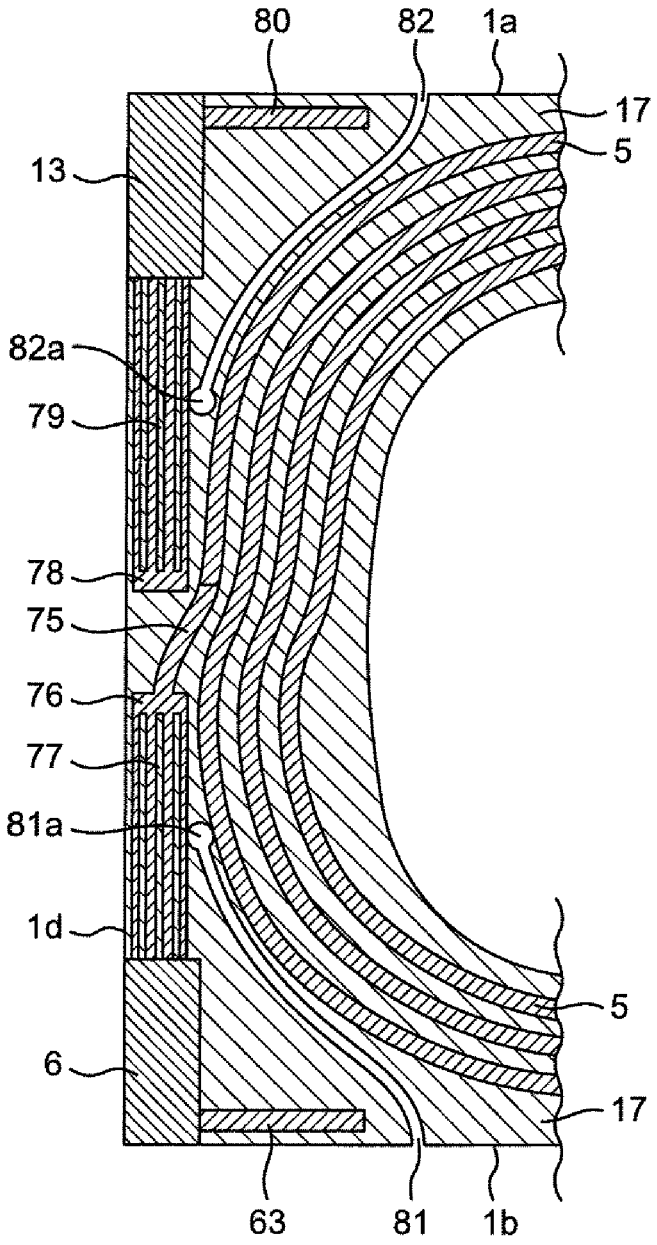
FIG. 11 is a partial bottom view illustrating an example of the configuration of a coil substrate configuring a flexible inductor according to an eighth embodiment of the present disclosure.

A flexible inductor in the embodiment has the same configuration as that in the sixth embodiment other than a point that front end portions of cutout portions are arranged in the vicinity of third reinforcing conductors or arranged so as to make contact with the third reinforcing conductors. FIG. 11 is a partial bottom view illustrating a coil substrate configuring the flexible inductor in the embodiment. The spiral conductor 5 is formed on the lower surface of the flexible board 17 and the first outer electrode 6 is electrically connected to the outermost end portion of the spiral conductor 5 in the radial direction with a first extended line 75 interposed therebetween. The first extended line 75 has a third reinforcing conductor 76, the third reinforcing conductor 76 is formed by a plurality of band-like conductors 77 arranged in parallel with one another, and the adjacent band-like conductors are connected to each other at both ends of the plurality of band-like conductors 77. The second reinforcing conductor 63 extending along the extension direction of the first side 1*b* is also connected to the first outer electrode 6. A cutout portion 81 formed by cutting the coil substrate such that a front end portion 81*a* thereof makes contact with the third reinforcing conductor 76 is provided in the vicinity of the first outer electrode 6. A first reinforcing conductor 80 extending along the extension direction of the first side 1*a* and a third reinforcing conductor 78 extending along the extension direction of the second side 1*d* are connected to the fourth outer electrode 13, the third reinforcing conductor 78 is formed by a plurality of band-like conductors 79 arranged in parallel with one another, and the adjacent band-like conductors are connected to each other at both ends of the plurality of band-like conductors 79. A cutout portion 82 formed by cutting the coil substrate such that a front end portion 82*a* thereof makes contact with the third reinforcing conductor 78 is provided in the vicinity of the fourth outer electrode 13.

With the embodiment, the front end portions of the cutout portions are arranged in the vicinity of the third reinforcing conductors or arranged so as to make contact with the third reinforcing conductors. With this configuration, the coil substrate is easy to be deformed in the cutout portions and the third reinforcing conductors. Therefore, the stress that is applied to the coil substrate and the outer electrodes can be further dispersed and moderated.

Ninth Embodiment

A flexible inductor in the embodiment includes a coil substrate having a spiral conductor on at least one of an upper surface and a lower surface, and a first magnetic sheet laminated on the upper surface of the coil substrate and a second magnetic sheet laminated on the lower surface of the coil substrate. The coil substrate has a square lower surface with a pair of first sides opposing each other and a pair of second sides opposing each other, a first outer electrode that makes direct contact with the lower surface of the coil substrate and is electrically connected to an outermost end portion of the spiral conductor, a second outer electrode that makes direct contact with the lower surface of the coil substrate and is electrically connected to an innermost end portion of the spiral conductor, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate. First reinforcing conductors extending along an extension direction of at least one of the first sides and the second sides are respectively connected to the third outer electrode and the fourth outer electrode.

Figure 12:
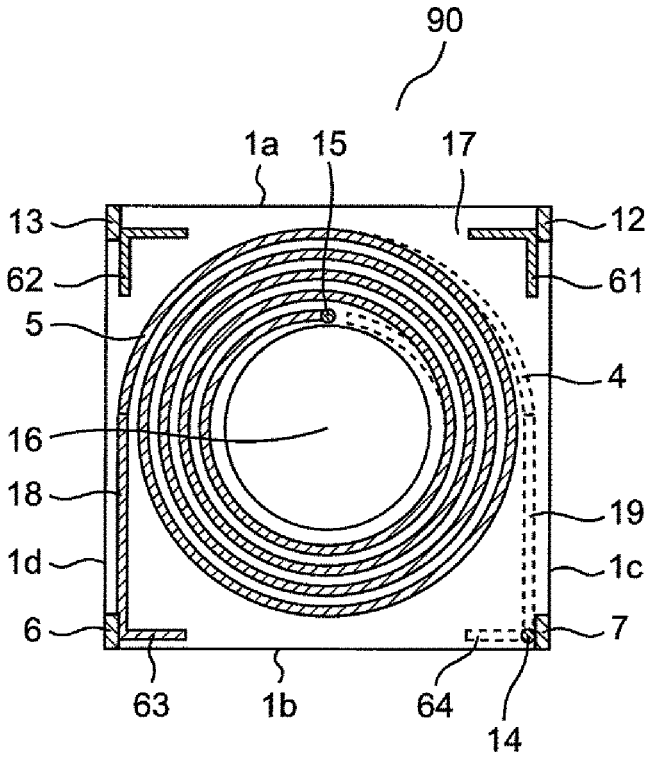
FIG. 12 is a partial bottom view illustrating an example of the configuration of a coil substrate configuring a flexible inductor according to a ninth embodiment of the present disclosure.

The flexible inductor in the embodiment has the same configuration as that of the flexible inductor in the fourth embodiment other than a point that the thicknesses of the first outer electrode and the second outer electrode are not particularly limited. That is to say, as illustrated in FIG. 12, a coil substrate 90 has a square lower surface with the pair of first sides 1*a* and 1*b* opposing each other and the pair of second sides 1*c* and 1*d* opposing each other. The L-shaped first reinforcing conductors 61 and 62 extending along the extension directions of both of the first side 1*a* and the second side 1*c* are respectively connected to the third outer electrode 12 and the fourth outer electrode 13. The first outer electrode 6 is electrically connected to the outermost end portion of the spiral conductor 5 with the first extended line 18 extending along the extension direction of the first side 1*d* interposed therebetween, and the second outer electrode 7 is electrically connected to the innermost end portion of the spiral conductor 5 with the second extended line 19 extending along the extension direction of the first side 1*c* interposed therebetween. The second reinforcing conductors 63 and 64 extending along the extension direction of the second side 1*b* are respectively connected to the first outer electrode 6 and the second outer electrode 7.

The third outer electrode and the fourth outer electrode are not connected to the spiral conductor. Therefore, when the flexible substrate is deformed, stress is easy to concentrate on the interface between the coil substrate and the third outer electrode and/or the interface between the coil substrate and the fourth outer electrode. With the embodiment, the first reinforcing conductors are respectively connected to the third outer electrode and the fourth outer electrode that are not connected to the spiral conductor. With this configuration, the stress that is applied to the interface between the coil substrate and the third outer electrode and/or the interface between the coil substrate and the fourth outer electrode can be dispersed. Furthermore, the outer electrodes are directly provided on the coil substrate. Therefore, the coil substrate can be deformed while following deflection of the flexible substrate. Accordingly, the strength against deformation is increased and the resistance to mechanical impact such as drop can be increased.

FIG. 12 illustrates the example in which the first reinforcing conductors extend in the extension directions of both of the first side and the second side. Alternatively, the first reinforcing conductors may extend along the extension direction of only one of the first side 1*a* and the second side 1*c*. The widths and the lengths of the first reinforcing conductors 61 and 62 are not particularly limited as long as the first reinforcing conductors 61 and 62 do not make contact with the spiral conductor 5. Although FIG. 12 illustrates the example in which the second reinforcing conductors are respectively provided for the first outer electrode and the second outer electrode, the second reinforcing conductors can be omitted if necessary. In the flexible inductor in the embodiment, the thicknesses of the first outer electrode and the second outer electrode are not particularly limited and may be equal to, larger than, or smaller than the thickness of the second magnetic sheet.

A large number of variations on the flexible inductor in the embodiment can be made. For example, as described in the fifth embodiment, one or a plurality of cutout portions can also be provided in the vicinity of at least one outer electrode. Furthermore, as described in the sixth embodiment, the third reinforcing conductor can be connected to at least one outer electrode. As described in the seventh embodiment, the first extended line having the third reinforcing conductor can also be made to extend in the meander-like manner and be arranged along the cutout portion. As described in the eighth embodiment, the front end portions of the cutout portions can also be arranged in the vicinity of the third reinforcing conductor or arranged so as to make contact with the third reinforcing conductor. The configuration provided by combining the plurality of the above-described configurations in the fifth to eighth embodiments can also be employed.

As described above, the preferred embodiments have been described. The present disclosure is not however limited to the above-described embodiments and various variations and replacements can be added in a range without departing from the scope of the present disclosure.

What is claimed is:

1. A flexible inductor comprising:

a coil substrate having a spiral conductor on at least one of an upper surface and a lower surface; and a first magnetic sheet laminated on the upper surface of the coil substrate and a second magnetic sheet laminated on the lower surface of the coil substrate, a first outer electrode that makes direct contact with the lower surface of the coil substrate and is electrically connected to an outermost end portion of the spiral conductor, and a second outer electrode that makes direct contact with the lower surface of the coil substrate and is electrically connected to an innermost end portion of the spiral conductor, are provided in a peripheral edge portion of the lower surface of the coil substrate and the second magnetic sheet is laminated on the lower surface of the coil substrate other than portions corresponding to the first outer electrode and the second outer electrode, the first outer electrode and the second outer electrode each including a plurality of columnar conductors and a hat-like conductor formed on a top of each columnar conductor to connect each respective plurality of columnar conductors, thicknesses of the first outer electrode and the second outer electrode are equal to a thickness of the second magnetic sheet or are larger than the thickness of the second magnetic sheet, and in the coil substrate, a center portion of a flexible board is removed to form a cavity, and the first magnetic sheet and the second magnetic sheet are bonded to each other in the cavity via at least one adhesive sheet.

2. The flexible inductor according to claim 1, wherein the coil substrate has one or a plurality of cutout portions in the vicinity of at least one of the first outer electrode and the second outer electrode.

3. The flexible inductor according to claim 1, wherein:

the coil substrate has a square lower surface, the first outer electrode, the second outer electrode, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate;

the second magnetic sheet is laminated on the lower surface of the coil substrate other than portions corresponding to the first outer electrode, the second outer electrode, the third outer electrode, and the fourth outer electrode; and thicknesses of the first outer electrode, the second outer electrode, the third outer electrode, and the fourth outer electrode are equal to the thickness of the second magnetic sheet or are larger than the thickness of the second magnetic sheet.

4. The flexible inductor according to claim 3, wherein the coil substrate has one or a plurality of cutout portions in the vicinity of at least one of the third outer electrode and the fourth outer electrode.

5. The flexible inductor according to claim 2, wherein:

the coil substrate has a square lower surface, the first outer electrode, the second outer electrode, a third outer electrode that makes direct contact with the lower surface of the coil substrate and is not connected to the spiral conductor, and a fourth outer electrode that makes direct contact with the lower surface of the coil substrate and is not connected to the spiral conductor are provided at four corners of the lower surface of the coil substrate;

the second magnetic sheet is laminated on the lower surface of the coil substrate other than portions corresponding to the first outer electrode, the second outer electrode, the third outer electrode, and the fourth outer electrode; and thicknesses of the first outer electrode, the second outer electrode, the third outer electrode, and the fourth outer electrode are equal to the thickness of the second magnetic sheet or are larger than the thickness of the second magnetic sheet.

6. A method for manufacturing a flexible inductor which includes a coil substrate having a spiral conductor on at least one of an upper surface and a lower surface, and a first magnetic sheet laminated on the upper surface of the coil substrate and a second magnetic sheet laminated on the lower surface of the coil substrate, the method comprising:

forming a first outer electrode that makes direct contact with the lower surface of the coil substrate and is electrically connected to an outermost end portion of the spiral conductor and a second outer electrode that makes direct contact with the lower surface of the coil substrate and is electrically connected to an innermost end portion of the spiral conductor in a peripheral edge portion of the lower surface of the coil substrate, the first outer electrode and the second outer electrode each including a plurality of columnar conductors and a hat-like conductor formed on a top of each columnar conductor to connect each respective plurality of columnar conductors; and laminating the second magnetic sheet on the lower surface of the coil substrate other than portions corresponding to the first outer electrode and the second outer electrode so as to have a thickness that is equal to thicknesses of the first outer electrode and the second outer electrode or is smaller than the thicknesses of the first outer electrode and the second outer electrode, wherein in the coil substrate, a center portion of a flexible board is removed to form a cavity, and the first magnetic sheet and the second magnetic sheet are bonded to each other in the cavity via at least one adhesive sheet.

7. A flexible inductor comprising:

a coil substrate having a spiral conductor on at least one of an upper surface and a lower surface; and a first magnetic sheet laminated on the upper surface of the coil substrate and a second magnetic sheet laminated on the lower surface of the coil substrate, wherein a first outer electrode that makes direct contact with the lower surface of the coil substrate and is electrically connected to an outermost end portion of the spiral conductor, and a second outer electrode that makes direct contact with the lower surface of the coil substrate and is electrically connected to an innermost end portion of the spiral conductor, are provided in a peripheral edge portion of the lower surface of the coil substrate and the second magnetic sheet is laminated on the lower surface of the coil substrate other than portions corresponding to the first outer electrode and the second outer electrode, the first outer electrode and the second outer electrode each including a plurality of columnar conductors and a hat-like conductor formed on a top of each columnar conductor to connect each respective plurality of columnar conductors, thicknesses of the first outer electrode and the second outer electrode are equal to a thickness of the second magnetic sheet or are larger than the thickness of the second magnetic sheet, in the coil substrate, a center portion of a flexible board is removed to form a cavity, and the first magnetic sheet and the second magnetic sheet are directly bonded to each other in the cavity.

8. A method for manufacturing a flexible inductor which includes a coil substrate having a spiral conductor on at least one of an upper surface and a lower surface, and a first magnetic sheet laminated on the upper surface of the coil substrate and a second magnetic sheet laminated on the lower surface of the coil substrate, the method comprising:

forming a first outer electrode that makes direct contact with the lower surface of the coil substrate and is electrically connected to an outermost end portion of the spiral conductor and a second outer electrode that makes direct contact with the lower surface of the coil substrate and is electrically connected to an innermost end portion of the spiral conductor in a peripheral edge portion of the lower surface of the coil substrate, the first outer electrode and the second outer electrode each including a plurality of columnar conductors and a hat-like conductor formed on a top of each columnar conductor to connect each respective plurality of columnar conductors; and laminating the second magnetic sheet on the lower surface of the coil substrate other than portions corresponding to the first outer electrode and the second outer electrode so as to have a thickness that is equal to thicknesses of the first outer electrode and the second outer electrode or is smaller than the thicknesses of the first outer electrode and the second outer electrode, wherein in the coil substrate, a center portion of a flexible board is removed to form a cavity, and the first magnetic sheet and the second magnetic sheet are directly bonded to each other in the cavity.

* * * * *